United States Patent [19]

Katsura et al.

[11] Patent Number: 4,745,965

[45] Date of Patent: May 24, 1988

[54] SEPARATE TYPE HEAT EXCHANGER

[75] Inventors: Akiji Katsura; Shiro Endo; Tatsuya Koizumi, all of Tokyo; Junji Sotani, Yokohama; Yuichi Kimura, Yokohama, all of Japan

[73] Assignee: Furukawa Electric Co., Ltd., Tokyo, Japan

[21] Appl. No.: 894,738

[22] Filed: Aug. 11, 1986

Related U.S. Application Data

[63] Continuation of Ser. No. 709,149, Mar. 7, 1985, abandoned.

[30] Foreign Application Priority Data

Mar. 7, 1984 [JP] Japan ..... 59-43532
Jun. 12, 1984 [JP] Japan ..... 59-120158
Sep. 21, 1984 [JP] Japan ..... 59-198104

[51] Int. Cl.[4] ..... F28D 15/02

[52] U.S. Cl. ..... 165/104.14; 165/104.21; 165/909; 122/366

[58] Field of Search ..... 165/104.14, 104.21; 122/366

[56] References Cited

U.S. PATENT DOCUMENTS 4,182,306 1/1980 Tomich ..... 165/104.21
4,285,394 8/1981 Stewart ..... 165/104.21

FOREIGN PATENT DOCUMENTS 1028617 5/1953 France ..... 165/104.21
111551 9/1978 Japan ..... 165/104.14
73101 3/1980 Japan .
140092 11/1980 Japan .
16187 1/1983 Japan .

*Primary Examiner*—Albert W. Davis, Jr.
*Attorney, Agent, or Firm*—Armstrong, Nikaido, Marmelstein & Kubovcik

[57] ABSTRACT

A separate type heat exchanger characterized in that the evaporation section heated by the hot fluid is formed by fitting a plurality of the evaporation pipes horizontally between the vapor header pipe and the condensed liquid header pipe, the condensation section cooled by the cold fluid is formed above said evaporation section by fitting a plurality of the condensation pipes between the vapor header pipe and the condensed liquid header pipe, both vapor header pipes are connected through the vapor pipe and both condensed liquid header pipes are connected through the condensed liquid pipe to form a circulation path, and said path contains the working fluid is sealed within said path which circulates by evaporating at the evaporation section and condensing at the condensation section.

2 Claims, 5 Drawing Sheets

SEPARATE TYPE HEAT EXCHANGER

This application is a continuation of application Ser. No. 709,149 filed Mar. 7, 1985 now abandoned.

DETAILED DESCRIPTION OF THE INVENTION

[Applicable Fields in the Industry]

The present invention relates to a separate type heat exchanger to which is applied the principle of the heat pipe, horizontal evaporation pipes and a method of refluxing the condensed liquid thereof. The invention provides an improvement in the heat transfer rate and makes it easy to remove the dust adhering to the outer surface of the evaporation pipes at the evaporation section. The invention also makes the reflux of the condensed liquid easy, even when the difference in the head of condensed liquid is great between the evaporation section and the condensation section due to the loss of vapor pressure in the device or when the quantity of the condensed liquid to be refluxed is small due to the high temperature.

[Conventional Techniques]

In general, the heat pipes excellent in the heat transfer coefficient are used for the recovery of the sensible heat of the industrial exhaust gas, effluent, etc. The heat pipe, in which the working fluid contained an air-evacuated closed pipe having excluded the air is allowed to evaporate at one end and condense at the other end to emit the heat, has an excellent heat transfer characteristic and is often called ultra heat conductor. Applying this principle, the heat exchangers, in which the evaporation pipes are connected with the condensation pipes through vapor pipe and condensed liquid pipe to form a closed path and the working fluid is fed in said path after removal of the air, have been developed and have found use in the heat recovery and many other uses.

The heat pipes are fitted usually passing through the partition plate provided between the heat-supplying fluid such as exhaust gas, effluent, or the like and the heat-receiving fluid. Therefore, the contrivance was needed for the structure of the partition plate, and, it was not only impossible to avoid the leakage from the side of heat-supplying fluid to the side of heat-receiving fluid, but also very difficult to replace the damaged heat pipes. Moreover, depending upon the natures and the conditions of heat-supplying fluid and heat-receiving fluid, there occurs a necessity to arrange the evaporation section and the condensation section of the heat pipes in separation. However, if lengthening the heat pipe, there arises a shortcoming that affords the resistance to the flow of vapor by the interflow of vapor with condensed liquid resulting from the utilization of the gravity for returning the condensed working fluid to the evaporation section.

While, the heat transfer coefficient in the evaporation pipes has a important part of the heat exchanged of the heat exchanger. Particularly, in the pipes in which the evaporation occurs, both the gas phase regime and the liquid phase regime are formed, and the heat transfer coefficient is very low in the gas phase. Therefore, the improvement in the heat transfer coefficient is strived for by providing the evaporation pipes vertically and forming the circular flow. However, since the available length of the circular flow is shorter than the length of the evaporation pipes, the heat transfer coefficient remains at a level not so high. Moreover, if using the heat source containing dusts as exhaust gas for heating, the dusts tend to adhere to the outer surface of the evaporation pipes resulting in a decrease in the heat transfer coefficient outside the pipes. Accordingly, it becomes necessary to remove these, but the removal of the dusts is very difficult for the fins provided on the outer side of the pipes to enlarge heat transfer area.

In order to improve these points, the separate type heat exchanger to which is applied the principle of the heat pipe has been developed and put into practice. In this device, as shown in FIG. 1, a plurality of the evaporation pipes (1) are arranged vertically, the vapor header pipe (2) is fitted to the upper ends of these pipes and the condensed liquid header pipe (3) is fitted to the lower ends of these pipes to form the evaporation section (A). Further, above said evaporation section (A), a plurality of the condensation pipes (4) are arranged vertically, the vapor header pipe (5) is fitted to the upper ends of these pipes and the condensed liquid header pipe (6) is fitted to the lower ends of these pipes to form the condensation section (B). Then, both vapor header pipes (2) and (5) are connected through the vapor pipe (7) and both condensed liquid header pipes (3) and (6) are connected through the condensed liquid pipe (8) to form the circulation path. Finally, said path is fed with the working fluid inside which circulates by evaporating at the evaporation section (A) and condensing at the condensation section (B).

This device is used generally by arranging a plurality of devices in parallel and fitting the radial fins on the surface of the vertical evaporation pipes. For this reason, there are shortcomings that the dusts not only tend to adhere but also the removal thereof is very difficult to remove. Moreover, in the evaporation section, as shown in FIG. 2, it is necessary to keep the height of the level of working fluid h in the evaporation pipes (1) to an appropriate value. However, since not only the height $h_1$ varies depending upon the heating conditions but also the level of working fluid $h_2$ condensed and flowed downward naturally in the condensed liquid pipe (8) is different from the level of working fluid $h_1$ in the evaporation pipes (1), the control of the quantity of working fluid is very difficult and it is impossible to get rid of the dried surface inside the evaporation pipes, even if could be adjusted to an appropriate value. Therefore, there was a shortcoming that the heat transfer coefficient was inferior to that of single pipe type heat pipes (conventional type).

[Problems to be Solved by the Invention]

The invention aims at the solution of the shortcoming as described above. Namely, the object of the invention is to develop the separate type heat exchanger which makes it easy to control the working fluid has a high heat transfer coefficient, and is capable of removing the dusts adhering to the outer surface of the evaporation pipes. As a result of the elaborate investigations in view of this situation, a separate type heat exchanger using the horizontal evaporation pipes has been developed. However, the heat transfer coefficient of the heat exchanger, in which not only the removal of the dusts is easy but also approximately same or higher heat transfer coefficient can be obtained as compared with that of the heat exchanger used the vertical evaporation pipes, is not so high as to be satisfied sufficiently, and further improvement is desired.

Furthermore, in the heat exchanger described above, the vapor pressure loss becomes serious as the speed of vapor flowing in the adiabatic vapor pipe becomes faster or the length of the adiabatic vapor pipe becomes longer. In this case, the difference of the head Δh described above also becomes large, so that it is necessary to arrange the position of the condensation section higher than 10 m from that of the evaporation section as the case may be. The installation price of the separate type heat exchanger as this would become very expensive. In order to solve this, it is known to enlarge the diameter of the adiabatic vapor pipe, but, for this, the thickness of the wall is to be increased to withstand the pressure resulting in the significant disadvantage in the economic aspect. Also, it is known to use the circulating pump, but the use of the pump causes the shortcomings that not only the price becomes expensive but also the reliability becomes lacking.

[Means to Solve the Problems]

At the first phase of the invention, the separate type heat exchanger has been developed, which is characterized in that the evaporation section heated by the hot fluid is formed by fitting a plurality of the evaporation pipes horizontally between the vapor header pipe and the condensed liquid header pipe, the condensation section cooled by cold fluid is formed upward said evaporation section by fitting a plurality of the condensation pipes between the vapor header pipe and the condensed liquid header pipe, both vapor header pipes are connected through the vapor pipe and both condensed liquid header pipes are connected through the condensed liquid pipe to form the circulation path, and the working fluid is sealed within said path which circulates by evaporating at the evaporation section and condensing at the condensation section.

Namely, in the invention, as shown in FIG. 3, a plurality of the evaporation pipes (1) are arranged horizontally, the vapor header pipe (2) is fitted to one end and the condensed liquid header pipe (3) is fitted to the other end, and, at the side of the condensed liquid header pipe (3) of the evaporation pipes (1), the wall for preventing the back flow of generated vapor (not shown in the figure) is provided to form the evaporation section (A) heated by the hot fluid such as exhaust gas, effluent, or the like. Furthermore, upward evaporation section (A), a plurality of the condensation pipes (4) are arranged vertically or in inclined state (the figure shows the vertical arrangement), the vapor header pipe (5) is fitted to the upper end and the condensed liquid header pipe (6) is fitted to the lower end to form the condensation section (B) cooled by the cold fluid. Both vapor header pipes (2) and (5) at the evaporation section (A) and at the condensation section (B) are connected through the vapor pipe (7) and both condensed liquid header pipes (3) and (6) are connected through the condensed liquid pipe (8) to form the circulation path. Finally, this path is fed with the working fluid this path which circulates by evaporating at the evaporation section (A), condensing at the condensation section (B) and flowing down naturally in the condensed liquid pipe (8).

In this device as well as the conventional device, the heat exchange is conducted by allowing the vapor generated at the evaporation section to condense at the condensation section and to reflux to the evaporation section again. During this refluxing, as shown in FIG. 2 and FIG. 12, a difference of the head Δh between the level of the liquid in the evaporation section (A) and the level of the liquid in the adiabatic condensed liquid pipe (8) due to the pressure loss in the pipes is caused. Conventionally, either the height of the condensation section was made different from that of the evaporation section under the anticipation of this difference of the head Δh beforehand, or the condensed liquid was allowed to reflux compulsively by the pump etc., if the difference of the height could not make.

Although an example was explained above in which all of the evaporation pipes, the vapor header pipe and the condensed liquid header pipe at the evaporation section were provided horizontally, the invention is not confined to this arrangement. For instance, as shown in FIG. 4, the vapor header pipe (2) may be arranged vertically in opposition to the condensed liquid header pipe (3) and a plurality of the evaporation pipes (1) may be fitted horizontally, between both header pipes (2) and (3). In this case, as shown in FIG. 5, it is more convenient that the end plate (9) is provided in each evaporation pipe (1) at the side of the vapor header pipe (2), the choke plates (10) provided the overflow pipe (11) are fitted to every evaporation pipes (1) in the condensed liquid header pipe (3) to control the height of the level of working fluid in the evaporation pipes (1), and the walls for the preventing the back flow of vapor (12) from the evaporation pipes (1) are provided at the ends of the evaporation pipes (1).

At the second phase of the invention, the horizontal evaporation pipe capable of obtaining high heat transfer coefficient has been developed. The evaporation pipe, which is to be fitted horizontally at the evaporation section in the heat exchanger and allows the inner working liquid to evaporate by heating from outside, is characterized in that a thin-walled cylindrical body, which can form a narrow clearance with the inner wall and has the passing-through opening for vapor at the upper part and the passing-through opening for working liquid at the lower part, is inserted into said pipe.

Namely, in the invention, as shown in FIG. 6 (A) and (B), the thin-walled cylindrical body (14) having a somewhat smaller diameter than that of the evaporation pipe (1), which can form a narrow clearance (15) with the inner wall of the pipe (1) and has the passing-through opening for vapor (16) at the upper part in the slit form continuing in the axial direction, is inserted into said pipe (1) to be fitted horizontally, and the lower part of both ends of the thin-walled cylindrical body (14) is used as the passing-through opening for working liquid. Although an example was explained in which the passing-through opening for vapor (16) was provided at the upper part of the thin-walled cylindrical body (14) in the slit form continuing in the axial direction, the invention is not confined to this form. For instance, the passing-through opening for vapor may be provided in a discontinuous slit form or in a form of the holes and the passing-through opening for working liquid may be provided at the lower part by making a plurality of the holes in the axial direction. Moreover, if the evaporation pipe (1) is short, the upper part of both ends of the thin-walled cylindrical body (14) may be used as the passing-through opening for vapor and the lower part thereof may be used as the passing-through opening for working liquid. Besides, (17) in the figure shows the fins provided on outer surface of the pipe for the enlargement of the heat-conducting area.

Moreover, FIGS. 7 (A) and (B) show that a plurality of the thin-walled cylindrical bodies (14*a*) and (14*b*) of short length having a somewhat smaller diameter than that of the evaporation pipe (1), which can form narrow clearances (15) with the inner wall of the pipe (1) and have the passing-through openings for vapor (16) at the upper parts in the slit forms continuing in the axial direction, are inserted leaving clearances (18) in said pipe (1) to be fitted horizontally, and said clearances between the thin-walled cylindrical bodies (18) are used as the passing-through opening for working liquid.

At the third phase of the invention, a refluxing method of the condensed liquid in the separate type heat exchanger, which enables to reflux the condensed liquid easily even when the difference of the head Δh due to the pressure loss is large and the quantity of the refluxing liquid is small at high temperature, has been developed. The method, which is employed when the evaporation section and the condensation section are arranged separately, the vapor sides thereof are connected through the adiabatic vapor pipe and the condensed liquid sides thereof are connected through the adiabatic condensed liquid pipe to form a closed circulation path, and the heat exchange is conducted by sealing the working fluid within said path and allowing it to cause the phase conversion (evaporation and condensation) at the evaporation section and the condensation section is characterized in that the switch valve is installed in the condensed liquid pipe below the condensation section and the condensed liquid accumulated on the valve is allowed to flow down intermittently by switching said valve intermittently.

Namely, in the invention, as shown in FIG. 9 (vertical system of the separate type heat exchanger) and FIG. 10 (horizontal system of the separate type heat exchanger), one or more than one of switch valves (20*a*) and (20*b*) (figures show use of two valves) are installed at intervals below the condensation section in the adiabatic condensed liquid pipe (8) connecting the condensed liquid (19) side of the evaporation section (A) and the condensed liquid (not shown in the figure) side of the condensation section, and the heat exchanging device is operated in a closed state of these valves. When the condensed liquid (19*a*) is accumulated on the switch valve (20*a*), the switch valve (20*a*) is opened to flow down the accumulated condensed liquid (19*a*) and then the switch valve (20*a*) is closed. Since the condensed liquid (19*b*) flowed down is accumulated on the switch valve (20*b*), the switch valve (20*b*) is opened to flow down this and then the switch valve (20*b*) is closed. By repeating these actions, the condensed liquid is allowed to reflux. Namely, the condensed liquid is allowed to flow down intermittently by providing more than one of switch valves and switching said valves.

As the switch valve, solenoid valve, rotary valve, switch valve connected with the motor operating machine, or the like is employed, and the switching is controlled automatically by means of the quantity of the refluxing condensed liquid and the difference of the pressure. Although the switch valve may be sufficient with one when the loss of the vapor pressure is small, it is desirable to provide at least more than two when the loss of the vapor pressure is large, and to provide more than three of the switch valves (20) in order to relieve the shock accompanied with the switching of the switch valve as shown in FIG. 11.

[Action]

First, in the heat exchanger of the invention, the evaporation pipes are arranged horizontally at the evaporation section as described above. Accordingly, since the working fluid can be supplied over the whole length of the evaporation pipes, the inside of the evaporation pipes is always maintained in a wet state resulting in the high heat transfer coefficient even though the working liquid in the evaporation pipes might fluctuate to some extent depending upon the evaporating conditions. Moreover, if the radial fins are fitted on the surface of the vapor pipe, the adherence of the dusts is very little because of the horizontal arrangement of the evaporation pipes. Even if the dusts would adhere, they can be removed easily by the washing with water or the shot cleaning system.

Secondly, in the horizontal evaporation pipe of the invention, narrow clearance is formed between the inner wall of said pipe and the thin-walled cylindrical body by inserting the thin-walled cylindrical body having a somewhat smaller diameter. Accordingly, the contact area with the working liquid inside the pipe can be increased due to the surface tension of the working liquid resulting in the high heat transfer coefficient, and the narrower the clearance, the more effective in the transfer coefficient. Moreover, when the horizontal evaporation pipe is short, the upper part and the lower part of both ends of the thin-walled cylindrical body can be used as the passing-through opening for vapor and the passing-through opening for working liquid, respectively, but, when the horizontal evaporation pipe is long, the ejection of the vapor and the supply of the working liquid become insufficient resulting in the cause of dry out. In this case, either the passing-through opening for vapor is formed appropriately at the upper part of the thin-walled cylindrical body in the axial direction and the passing-through opening for working liquid is provided at the lower part in the axial direction, or a plurality of the thin-walled cylindrical bodies of short length are inserted at intervals so as to the ejection of the vapor and the supply of the working liquid may be conducted sufficiently.

Thirdly, by the switching of the switch valve of the invention, the difference of the pressure may exist at the upper and lower sides thereof. The refluxing condensed liquid accumulates on the switch valve. At the that time, if the switch valve is opened, the refluxing condensed liquid having been accumulated flows down due to the gravity. At that time, if the switch valve is closed, the refluxing condensed liquid begins to accumulate again. By repeating these actions intermittently, the flowing down of the refluxing condensed liquid becomes possible even if the difference of the pressure might be exist. In particular, by conducting these actions in a plurality of the steps, the refluxing condensed liquid is allowed to flow down even in the existence of considerably high pressure difference.

[EXAMPLES]

(1) The evaporation pipe was made out by fitting the radial fins consisting of SPCC material and having a thickness of 1.0 mm, a height of 12.7 mm and a pitch of 5 mm to the outer circumference of a pipe consisting of STB 35 material and having an outside diameter of 50.8 mm, a thickness of the wall of 2 mm and a length of 1000 mm. Arranging five evaporation pipes horizontally, the evaporation section of the device of the invention shown in FIG. 4 was made. Also, the evaporation section of the conventional device at which five evaporation pipes were arranged vertically as shown in FIG. 1 was formed.

Employing these devices, water was supplied as the working fluid in the evaporation pipes at a coefficient of 50 vol. % and heat was added to the evaporation section in a quantity of $4.0\times10^3$ Kcal/m$^2$.h to $8.0\times10^3$ Kcal/m$^2$.h to measure the heat transfer coefficient of the evaporation. As a result, in the device of the invention, the heat transfer coefficient of the evaporation of 1500 to 3000 Kcal/m$^2$. h.° C. was obtained at the evaporation section. Whereas, in the conventional device, the heat transfer coefficient of the evaporation was 800 to 1500 Kcal/m$^2$.h.° C. at the evaporation section. From this, it can be seen that, according to the device of the invention, the heat transfer coefficient of the evaporation at the evaporation section is improved significantly.

Moreover, when used the exhaust gas for heating the evaporation section, the adhered amount of the dusts at the evaporation section in the device of the invention was found to be about less than a half of that at the evaporation section in the conventional device. As to the removal of the dusts, they could be removed very easily at the evaporation section in the device of the invention by the washing with water or/and the shot cleaning which were low in the treatment price. On the contrary, at the evaporation section of the conventional device, the removal of the dusts was impossible by the washing with water or/and the shot cleaning, and was difficult even by the soot blow system which was high in the treatment price.

(2) Employing the horizontal evaporation pipe fitted with the radial fins having a height of 12.7 mm and a pitch of 4.5 mm to the outer circumference of a stainless steel pipe having an outside diameter of 60.5 mm, a thickness of the wall of 1.5 mm and a length of 1320 mm and the condensation pipe consisting of fin tubes having a fin root diameter of 27.18 mm and a fin outside diameter of 51.25 mm, a circulation path shown in FIG. 8 was formed. Into the horizontal evaporation pipe, as shown in FIGS. 6 (A) and (B), a stainless steel cylindrical body having an outside diameter of 35 mm, 45 mm, 52 mm or 57 mm and a thickness of the wall of 1.2 mm, at the upper part of which the passing-through opening for vapor having a width of 15 mm, 20 mm, 30 mm or 40 mm was provided in the slit form in the axial direction, was inserted. The heat transfer coefficient of the evaporation in the pipe was measured and compared with that obtained in the case where the cylindrical body was not inserted into the evaporation pipe.

As a result, the heat transfer coefficient of the evaporation in the pipe was 1500 to 300 Kcal/m$^2$.h.° C. in the case without the insertion of the cylindrical body, but it was improved to 4000 to 7000 Kcal/m$^2$.h.° C. by inserting the cylindrical body. The heat transfer coefficient of the evaporation in the pipe was improved with an increase in the outside diameter of the cylindrical body inserted. Moreover it was improved with decreasing width of the slit, and the highest heat transfer coefficient was obtained with a slit width of 15 to 20 mm and an outside diameter of the cylindrical body of 52 to 57 mm.

(3) The evaporation pipe was made by fitting radial fins consisting of SPCC material and having a thickness of 1 mm and a height of 12.7 mm at pitches of 5 mm to the outer circumference of a pipe consisting of STB 35 material and having an outside diameter of 50.8 mm, a thickness of the wall of 2 mm and a length of 3000 mm. These were arranged horizontally, and, into said pipe, a cylindrical body consisting of SUS 304 material and having an outside diameter of 44 mm, a thickness of the wall of 0.8 mm and a length of 2995 mm, at the upper part of which a slit having a width of 10 mm was formed in the axial direction was inserted to form the horizontal evaporation pipe shown in FIGS. 6 (A) and (B). Also, six cylindrical bodies consisting of SUS 304 and having an outside diameter of 44 mm, a thickness of the wall of 0.8 mm and a length of 495 mm, at the upper part of which a slit having a width of 10 mm was formed in the axial direction were inserted leaving clearances of 5 mm to form the horizontal evaporation pipe shown in FIGS. 7 (A) and (B). Into both evaporation pipes, water was supplied as the working fluid at a rate of 40 vol. % and heat was added to the outer circumference of the pipes in a quantity of $4\times10^3$ Kcal/m$^2$.h to $10^4$ Kcal/m$^2$.h to measure the heat transfer coefficient of the evaporation.

As a result, the heat transfer coefficient of the evaporation obtained was 4000 to 7000 Kcal/m$^2$.h.° C. in the former case, while it was 4000 to 8500 Kcal/m$^2$.h.° C. in the latter case. When measured without the insertion of the cylindrical body for comparison, the heat transfer coefficient of the evaporation was 1500 to 3000 Kcal/m$^2$.h.° C.

Moreover, when the heat flux was enhanced during the measurements described above, in the horizontal evaporation pipe shown in FIGS. 6 (A) and (B), the working liquid was not supplied in the vicinity of the central portion of pipe and the dry out phenomenon was observed locally, but, in the horizontal evaporation pipe shown in FIGS. 7 (A) and (B), no abnormality was observed even if the heat flux might be enhanced.

(4) The radial fins consisting of SPCC material and having a thickness of 1.0 mm, a height of 12.7 mm and a pitch of 5 mm were fitted to the outer circumference of a pipe consisting of STB 35 material and having on outside diameter of 38.1 mm, a thickness of the wall of 2 mm, and a length of 1000 mm. Five of these were arranged vertically as the heat-conducting pipes, and the headers having a diameter of 50.8 mm were fitted to both ends thereof to form the evaporation section and the condensation section. These were arranged at separated positions in a state that the position of the condensation section is higher than that of the evaporation section by 3000 mm, the vapor sides thereof were connected through the adiabatic vapor pipe having an outside diameter of 38.1 mm, and the condensed liquid sides thereof were connected through the adiabatic condensed liquid pipe having an outside diameter of 25.4 mm to form the vertical system of the separate type heat exchanger as shown in FIG. 2. Into the device made out as this, water was sealed as the working fluid at a rate of 50 vol. % of the evaporation section and the heat flux was added to the evaporation section in a quantity of $4.0\times10^3$ to $8.0\times10^3$ Kcal/m$^2$.h per a pipe to conduct the heat exchange. In the experiment, the pressure loss was created conpulsively in the vapor pipe. As a result, the heat transfer coefficient obtained was only as high as 500 to 1500 Kcal/m$^2$.h.° C. This was because the difference of head $\Delta h$ due to the loss of the vapor pressure was high and the height of the level of liquid in the evaporation section was lowered.

Next, in the same device as above, two solenoid switch valves were installed at a interval of 300 mm in the adiabatic condensed liquid pipe below the condensation section as shown in FIG. 9, the switch valves were opened and closed alternately at every 30 seconds to flow down the condensed liquid intermittently, and the similar heat exchange was conducted. At this time, the heat transfer coefficient obtained was 1500 to 2000

Kcal/m$^2$.h.° C. This was because the condensed liquid could be refluxed without the effect of the difference of head Δh resulting from that the condensed liquid having been accumulated on the valve was allowed to flow down intermittently due to the gravity by switching the switch valves intermittently which had been installed in the condensed liquid pipe.

[EFFECTS OF THE INVENTION]

As described, according to the invention, the quantity of the working fluid in the evaporation pipes can be controlled easily, and the heat transfer coefficient of the evaporation obtained is about twice higher than that obtained at the evaporation section in the conventional device. Furthermore, the adhered amount of the dusts is very little, and, even if adhered, they can be removed easily. In addition, the reflux of the condensed liquid becomes possible without the effect of the difference of head Δh due to the loss of the pressure, it becomes possible to lengthen the adiabatic vapor pipe, and the circulating pump becomes unnecessary. For these reasons and others, the performance of the separate type heat exchanger can be enhanced and the application range thereof is magnified to exert the remarkable effects industrially.

Figure 1:
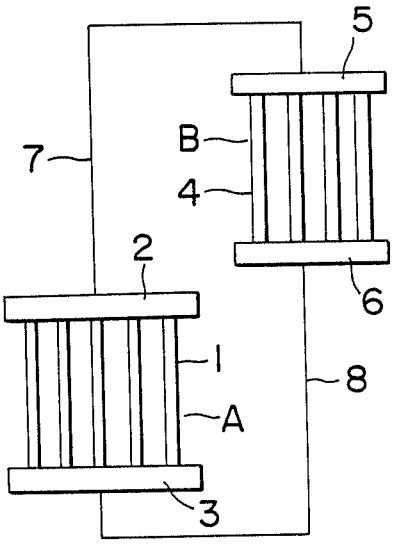
FIG. 1 PRIOR ART
FIG. 1 is an illustrative diagram showing an example of the conventional separate type heat exchanger
Figure 2:
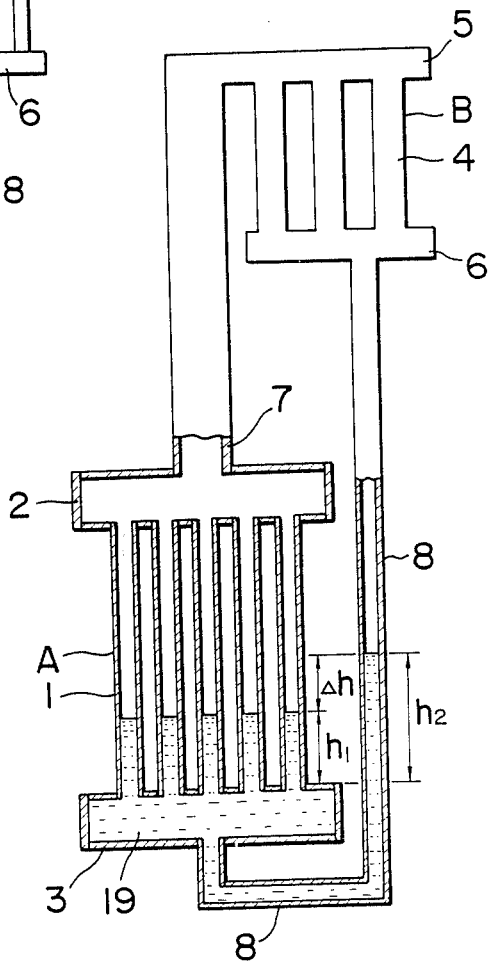
FIG. 2 PRIOR ART
FIG. 2 is a sectioned diagram showing an enlargement of the evaporation section in the same device.
Figure 3:
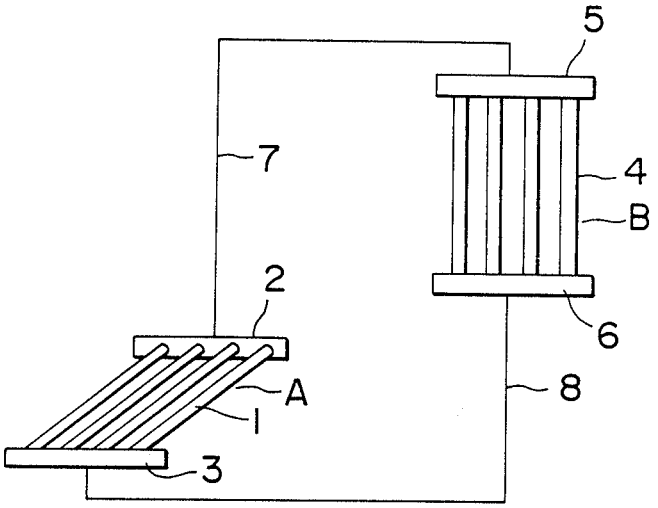
FIG. 3 is an illustrative diagram showing an example of the separate type heat exchanger of the invention.
Figure 4:
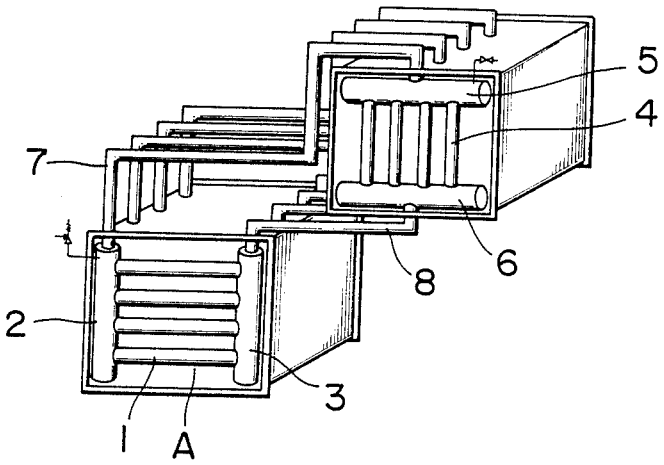
FIG. 4 is an oblique view showing another example of the device of the invention.
Figure 5:
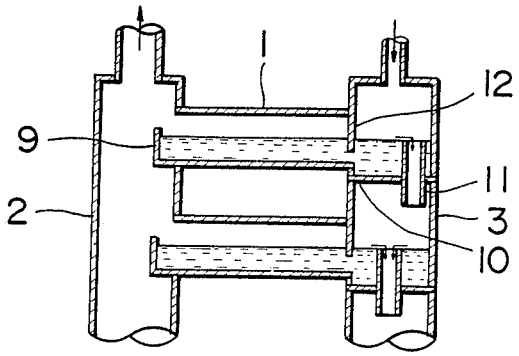
FIG. 5 is a partially notched sectioned diagram magnified the evaporation section of the same device.
Figure 6A:
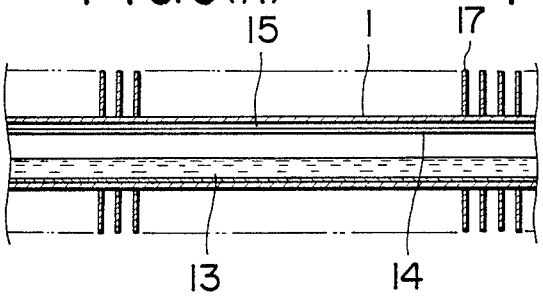
FIGS. 6 (A) and (B) show an example of the horizontal evaporation pipe of the invention, wherein (A) is a side cross section and (B) is a lateral cross section.
Figure 6B:
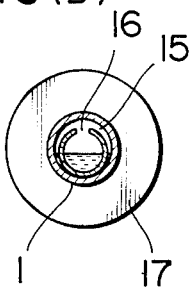
Figure 7A:
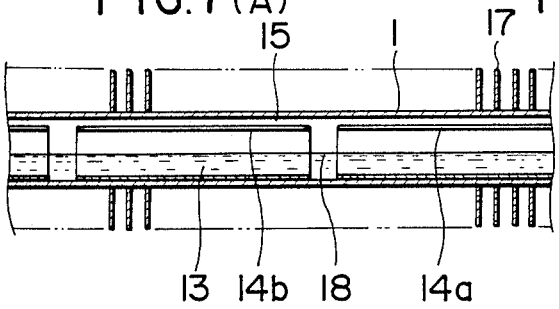
FIGS. 7 (A) and (B) show another example of the horizontal evaporation pipe of the invention, wherein (A) is a side cross section and (B) is a lateral cross section.
Figure 7B:
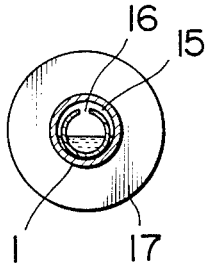
Figure 8:
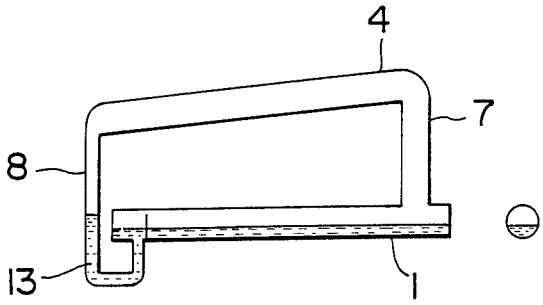
FIG. 8 is a conceptual diagram showing an example of the heat-exchanging device used the horizontal evaporation pipe.
Figure 9:
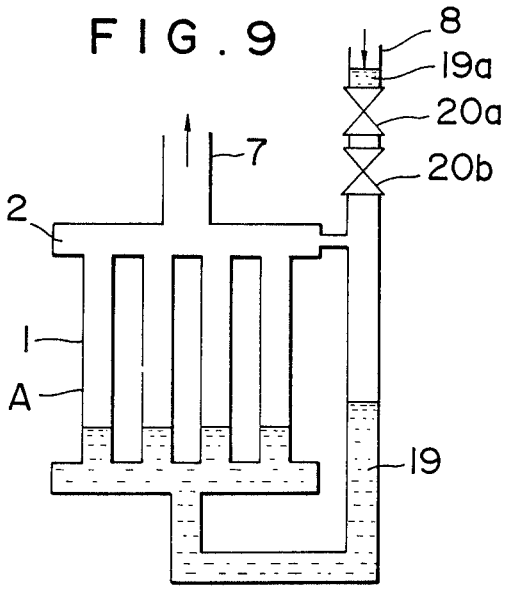
FIG. 9 is an illustrative diagram of the necessary portion showing an example of the refluxing method of the invention.
Figure 10:
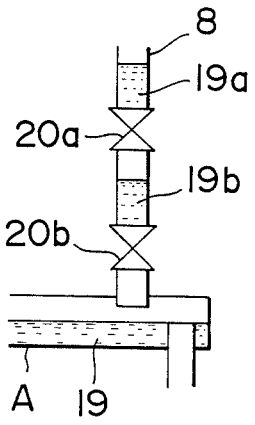
FIG. 10 is an illustrative diagram of the necessary portion showing another example of the refluxing method of the invention.
Figure 11:
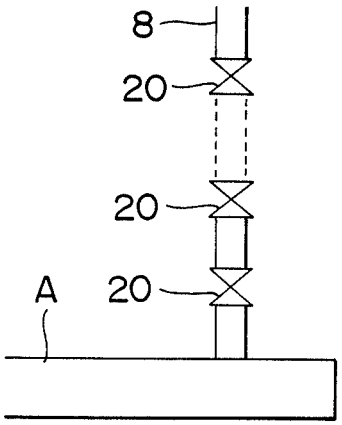
FIG. 11 is an illustrative diagram of the necessary portion showing third example of the refluxing method of the invention.
Figure 12:
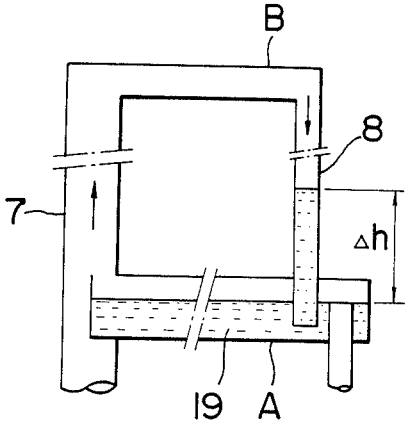
FIG. 12 is an illustrative diagram showing an example of the horizontal system of the separate type heat exchanger.

A . . . Evaporation section
B . . . Condensation section
1 . . . Evaporation pipe
2,5 . . . Vapor header pipe
3,6 . . . Condensed liquid header pipe
4 . . . Condensation pipe
7 . . . Vapor pipe
8 . . . Condensed liquid pipe
9 . . . End plate
10 . . . Choke plate
11 . . . Overflow pipe
12 . . . Wall for preventing the back flow of vapor
13 . . . Working fluid
14 . . . Thin-walled cylindrical body
15 . . . Narrow clearance
16 . . . Passing-through opening for vapor
17 . . . Fin
18 . . . Clearance
**19, 19*a*, 19*b*** . . . Condensed liquid
**20, 20*a*, 20*b*** . . . Switching valve

What is claimed is:

1. A separate type heat exchanger comprising (A) an evaporation section which comprises a plurality of evaporation pipes having their axes arranged in a horizontal direction, a first vapor header means connected to one end of said evaporation pipes and a first condensed liquid header means connected to the opposite end of said evaporation pipes; (B) a condensation section which comprises a plurality of condensation pipes, a second vapor header means connected to one end of said condensation pipes and a second condensed liquid header means connected to the other end of said condensation pipes; (C) a vapor pipe connecting said first and second vapor header means; (D) a condensed liquid pipe connected said first and second condensed liquid header means; (E) a working fluid sealed within said heat exchanger; said condensation section (B) being provided above said evaporation section (A) and said evaporation section (A), vapor pipe (C), condensation section (B) and condensed liquid pipe (D) providing a circulation path wherein the working fluid which is evaporated at the evaporation section (A) flows through the vapor pipe (C) to the condensation section (B) and working fluid which is condensed in the condensation section (B) flows through the condensed liquid pipe (D) to the evaporation section; and (F) means provided in said evaporation section to prevent the flow of vapor from the evaporation section (A) to the condensation section (B) through the condensed liquid pipe (D) without increasing the pressure in said condensed header means, said means (F) comprising a plurality of choke plates horizontally disposed in said condensed liquid header pipe, overflow pipes passing through said choke plates and extending above said choke plates a sufficient distance to maintain a liquid level above said choke plates, and a baffle closing an upper portion of each of said evaporation pipes, said baffles projecting downwardly a sufficient distance to terminate within the liquid confined by said choke plates and said header pipe.

2. The separate type heat exchanger of claim 1 further comprising means provided in the vapor header side of the evaporation pipes for maintaining a desired quantity of said working fluid in liquid form in said evaporation pipes.

* * * * *